United States Patent [19]

Brackett, Jr.

[11] Patent Number: 4,679,873

[45] Date of Patent: Jul. 14, 1987

[54] ELECTRICAL PLUG LOCK

[76] Inventor: John R. Brackett, Jr., 181 Dearborn Rd., Greenland, N.H. 03840

[21] Appl. No.: 906,219

[22] Filed: Sep. 8, 1986

[51] Int. Cl.[4] ..... H01R 13/44

[52] U.S. Cl. ..... 439/134; 439/135

[58] Field of Search ..... 339/37, 36

[56] References Cited

U.S. PATENT DOCUMENTS 2,955,272 10/1960 Gallardo ..... 339/37
3,345,600 10/1967 Scherer ..... 339/37
4,479,688 10/1984 Jennings ..... 339/37
4,488,764 12/1984 Pfenning et al. ..... 339/37

*Primary Examiner*—Gil Weidenfeld
*Assistant Examiner*—Paula A. Austin
*Attorney, Agent, or Firm*—Richard L. Miller

[57] ABSTRACT

An electric plug lock is provided for preventing the unauthorized use of an electrically operated appliance which has an electrical cord and plug. It operates by isolating the electrical prongs of the plug in a two part container and then locking the parts together with a conventional padlock.

3 Claims, 2 Drawing Figures

ELECTRICAL PLUG LOCK

BACKGROUND OF THE INVENTION

The instant invention relates generally to security devices and more particularly to a locking mechanism designed to prevent unauthorized persons from using any device having a cord and attached plug. Numerous conventional locking devices have been provided in the prior art such as those mentioned in U.S. Pat. Nos. 2,955,272; 3,345,600 and 4,488,764 all are illustrative of such prior art. While these units may be suitable for the particular purpose to which they address, they would not be as suitable for the purpose of the present invention as hereafter described.

SUMMARY OF THE INVENTION

This invention relates to a locking mechanism for use with any conventional electrical plug. Many times a person may wish to disable a plug so that an appliance cannot be operated or even connected to a source of power.

No convenient easy to use and cheap to manufacture device for accomplishing this has been made available.

To the accomplishment of such, an electrical plug lock is arranged so that the plug end of a cord from an appliance can be secured therein and locked inside.

A primary object of the present invention is to provide a cylindrical lock box for any conventional single or multiple prong plug.

Another object is to provide a cylindrical lock box for a plug that secures the cord such that it cannot bend and be damaged.

An additional object is to provide an electrical plug lock that is cheap to manufacture, easy to use and is durable.

A further object is to provide a plug lock with which the user can supply his/her own pad lock or combination lock.

A still further object is to provide a plug lock which prevents small children from tampering and fooling thus avoiding shock and/or damage to both valuable equipment or children.

A further object is to provide a plug lock which can be used with electrical plugs i.e. TV, radio and non electrical plugs i.e. telephone.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
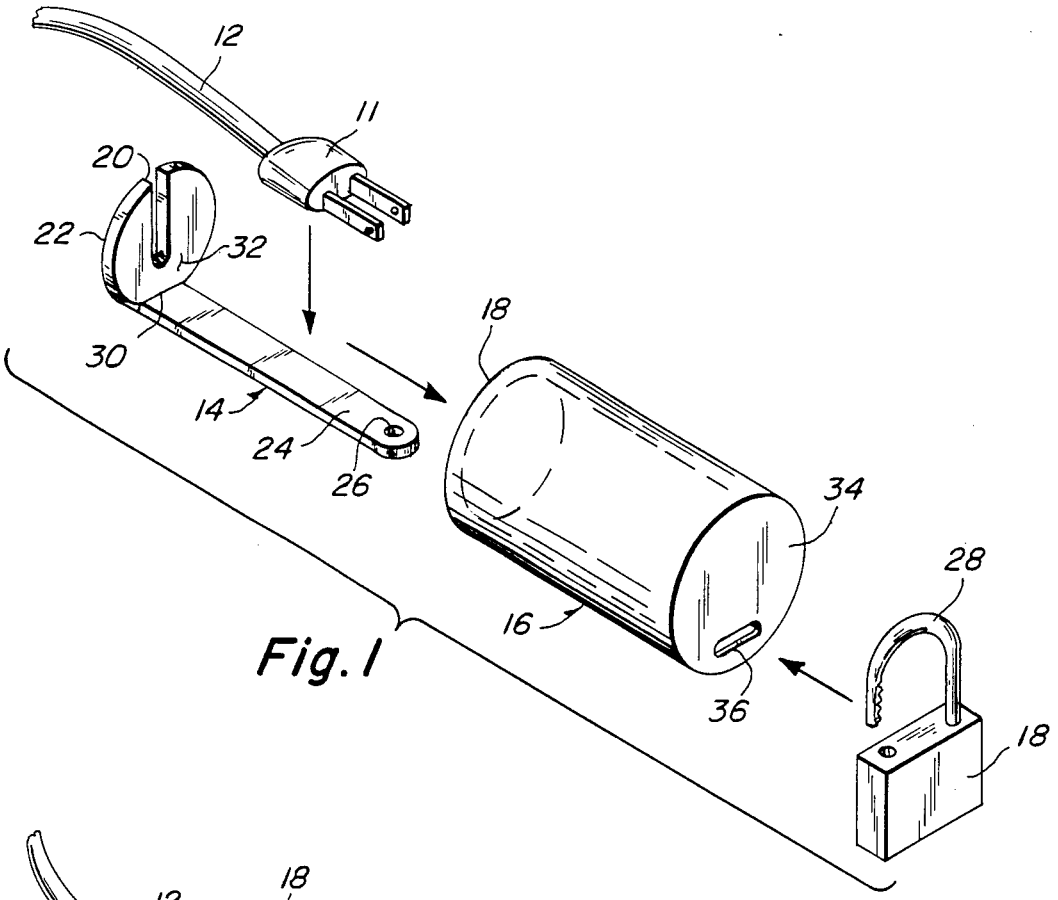
FIG. 1 is an exploded perspective view of the invention illustrating a line cord with a plug being secured therein.
Figure 2:
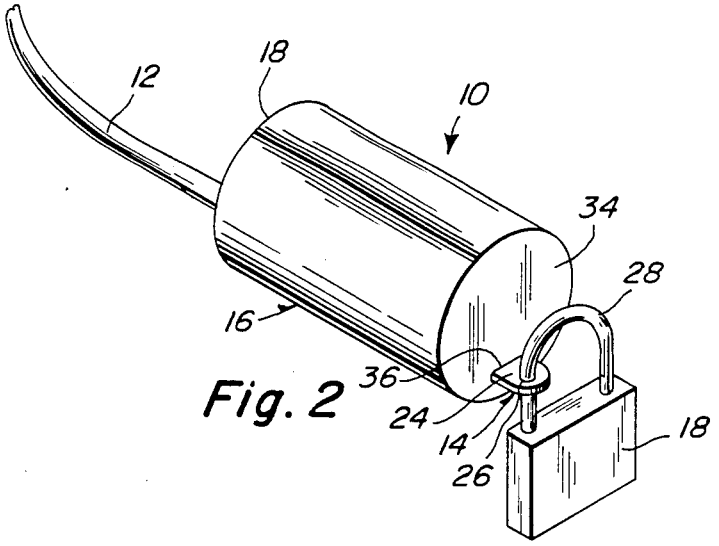
FIG. 2 is an assembled perspective view thereof.

Turning now descriptively to the drawings, in which like reference characters denote like elements throughout the several views, FIGS. 1 and 2 illustrate an electrical plug 11 and an electrical plug lock 10 for use for security purposes.

In FIG. 1 plug 11 is attached to cord 12 which can be attached to any electrical appliance (not shown).

The electrical plug lock 10 is generally comprised of two parts 14 and 16 respectively: a closure member 14 integrally formed of one piece has a circular back portion 22 with an elongated slot 20 through which an electrical cord 12 can be inserted. A tongue 24 projects from the circumferential edge 30 of back portion 22, opposite the elongated slot 20, at a right angle to the surface 32 of back portion 22. At the extreme end of the tongue 24 is a hole 26 through which the shackle 28 of a conventional padlock 18 maybe passed through.

A cylindrical housing 16 has an open end 18 into which back portion 22 of closure member 14 just fits.

The opposite end of housing 16 is closed by a wall 34 and has a bore 36 through which tongue 24 protrudes when the instant invention is assembled.

In operative use it will be seen, as shown in FIG. 2, that when the two components i.e. closure member 14 and cylindrical housing 16 are assembled that an electrical plug 11 may be encaptured inside of the electrical plug lock 10 and locked therein in such a manner that the plug cannot be removed therefrom except by first removing lock 18.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An electrical plug lock for security purposes which comprises:

(a) a housing for containing an electrical plug having a first open end and a second closed end with a through bore in said second closed end;

(b) a closure member which cooperatively fits together with said housing for capturing said electrical plug therein, wherein said closure member has a back portion having an elongated slot for receiving the cord of an electric plug and a tongue attached at a first end projecting from said back portion and having a hole at a second end; and (c) means for locking said housing together with said closure member whereby the removal of said electrical plug is prevented.

2. An electrical plug lock as recited in claim 1, wherein when said closure member is fitted together with said housing, said tongue passes through and out of said bore of said housing exposing said hole in said tongue.

3. An electric plug lock as recited in claim 1, wherein said means for locking said housing together with said closure member is accomplished by inserting a hasp of a lock through said exposed hole in said tongue when said closure member is cooperatively fitted together with said housing.

* * * * *